US009214767B1

(12) United States Patent
Yu et al.

(10) Patent No.: US 9,214,767 B1
(45) Date of Patent: Dec. 15, 2015

(54) ELECTRICAL CONNECTOR AND METHOD OF MAKING THE SAME

(71) Applicant: ALLTOP ELECTRONICS (SUZHOU) LTD., Taicang, JiangSu Province (CN)

(72) Inventors: Wang-I Yu, Jhonghe (TW); Mao-Jung Huang, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/564,262

(22) Filed: Dec. 9, 2014

(30) Foreign Application Priority Data

Sep. 5, 2014 (CN) ..... 2014 1 0451074

(51) Int. Cl.

| | |
|---|---|
| ***H01R 9/03*** | (2006.01) |
| ***H01R 13/6585*** | (2011.01) |
| ***H01R 43/24*** | (2006.01) |
| ***H01R 13/405*** | (2006.01) |

(52) U.S. Cl.
CPC ..... *H01R 13/6585* (2013.01); *H01R 13/405* (2013.01); *H01R 43/24* (2013.01)

(58) Field of Classification Search
CPC ... H01R 13/6585; H01R 43/24; H01R 13/405
USPC ..... 439/103, 607.05, 701, 717
See application file for complete search history.

(56) References Cited

U.S. PATENT DOCUMENTS

| | | | | |
|---|---|---|---|---|
| 4,687,267 | A * | 8/1987 | Header | H01R 12/725 439/607.07 |
| 5,195,899 | A * | 3/1993 | Yatsu | H01R 23/6873 439/101 |
| 8,475,216 | B2 * | 7/2013 | Tung | H01R 13/506 439/607.4 |
| 8,870,594 | B2 * | 10/2014 | McClellan | H01R 9/22 439/607.05 |
| 9,022,800 | B2 * | 5/2015 | Yang | H01R 13/6581 439/487 |

* cited by examiner

*Primary Examiner* — Khiem Nguyen
(74) *Attorney, Agent, or Firm* — Sughrue Mion, PLLC

(57) ABSTRACT

An electrical connector having an insulative housing, a middle grounding member and a pair of contact modules. The insulative housing has a mating portion, a body portion and an upper cavity and a lower cavity at upper and lower sides of the body portion. The mating portion has a top wall, a bottom wall, a pair of side walls and a receiving space therebetween. The middle grounding member is retained in the body portion. Each contact module has an insulator received in the upper or lower cavity, contacts and a locking spring in the insulator. The locking spring is at a lateral side of the contacts and has a fixing portion fixed in the insulator, a locking arm forwardly extending to the receiving space and an extension tab backwardly extending from a rear side of the fixing portion. Each contact has a contact arm extending to the receiving space.

20 Claims, 8 Drawing Sheets

ELECTRICAL CONNECTOR AND METHOD OF MAKING THE SAME

BACKGROUND

1. Technical Field

The present disclosure relates to an electrical connector, and more particularly to an electrical connector which can be assembled easily and method of making the same.

2. Description of Related Art

Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method. As of 2008, the USB specification was at version 3.0. Previous notable releases of the specification were 0.9, 1.0, 1.1 and 2.0. For improving the transmission rate of USB 2.0 connector, USB 3.0 connector adds two pairs of differential signal contacts and one grounding contact being based on the USB 2.0 connector. The transmission rate of the USB 3.0 connector is 5 GB/s, and the USB 3.0 connector is compatible to existing standard USB 2.0 connector.

However, with rapid development of the electrical industry in recent years, even the USB 3.0 connector can not be satisfied the transmission request of the electrical peripherals, and with increasing the transmission rate of the traditional connector, the contacts and other components of the connectors are added at the meantime. However, as the electrical peripherals are smaller than before, the assembling space for the electrical connector is smaller too which result in that the production of the electrical connector is more difficult to control.

It is desirable to provide an improved electrical connector and method of making the same for solving above problems.

SUMMARY

In one aspect, the present invention includes an electrical connector. The electrical connector includes an insulative housing having a mating portion, a body portion behind the mating portion and an upper cavity and a lower cavity located at upper and lower sides of the body portion respectively, the mating portion being provided with a top wall, a bottom wall, a pair of side walls and a receiving space formed therebetween; a middle grounding member being retained in the body portion; and a pair of contact modules, each of the contact modules having an insulator received in the upper or lower cavity, a plurality of contacts and a locking spring fixed in the insulator, the locking spring being arranged at a lateral side of the contacts and having a fixing portion fixed in the insulator, a locking arm forwardly extending to the receiving space and an extension tab backwardly extending from a rear side of the fixing portion, each of the contacts having a contact arm extending to the receiving space.

In another aspect, the present invention further includes a method of making an electrical connector. The method includes providing a plurality of contacts and locking springs and fixing the contacts and the locking springs to a pair of insulators in a preferred arrangement to form a pair of contact modules, the locking springs being arranged at lateral sides of the contacts; providing a middle grounding member and fixing the middle grounding member to an insulative housing, the insulative housing being provided with a mating portion, a body portion behind the mating portion and an upper cavity and a lower cavity located at upper and lower sides of the body portion respectively, the mating portion being provided with a top wall, a bottom wall, a pair of side walls and a receiving space formed therebetween, the middle grounding member being fixed in the body portion; and assembling the pair of contact modules to the upper and lower cavities respectively along an up to down direction, wherein each locking spring having a fixing portion fixed in the insulator, a locking arm forwardly extending to the receiving space and an extension tab backwardly extending from a rear side of the fixing portion, each of the contacts having a contact arm extending to the receiving space.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
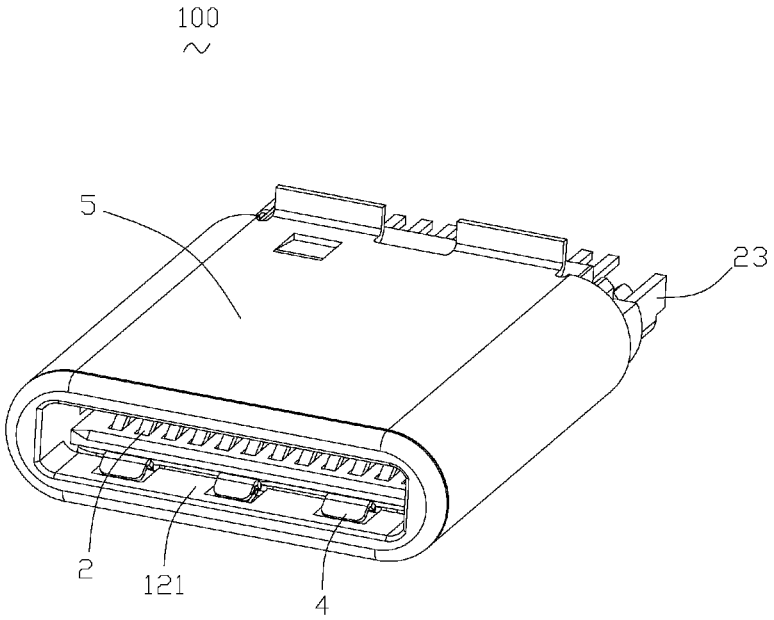
FIG. 1 is a perspective view illustrating a preferred embodiment of an electrical connector in the present disclosure.
Figure 2:
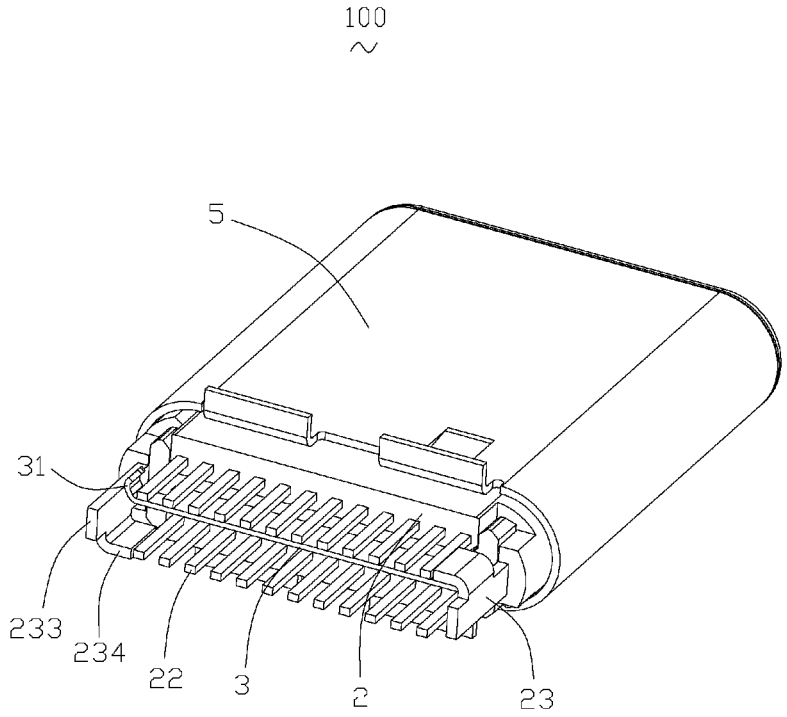
FIG. 2 is a view similar to FIG. 1, while viewed from another aspect.
Figure 3:
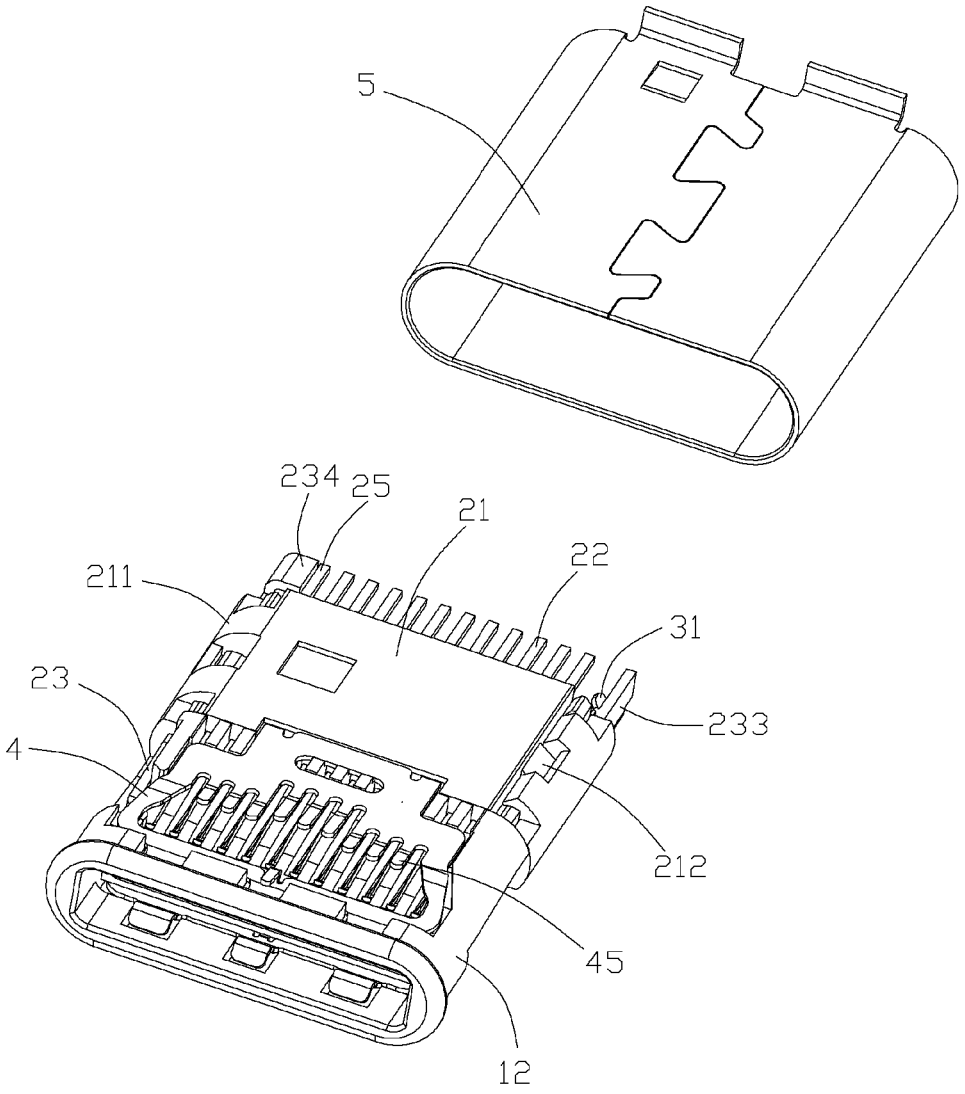
FIG. 3 is a partially exploded view of the electrical connector shown in FIG. 1.
Figure 4:
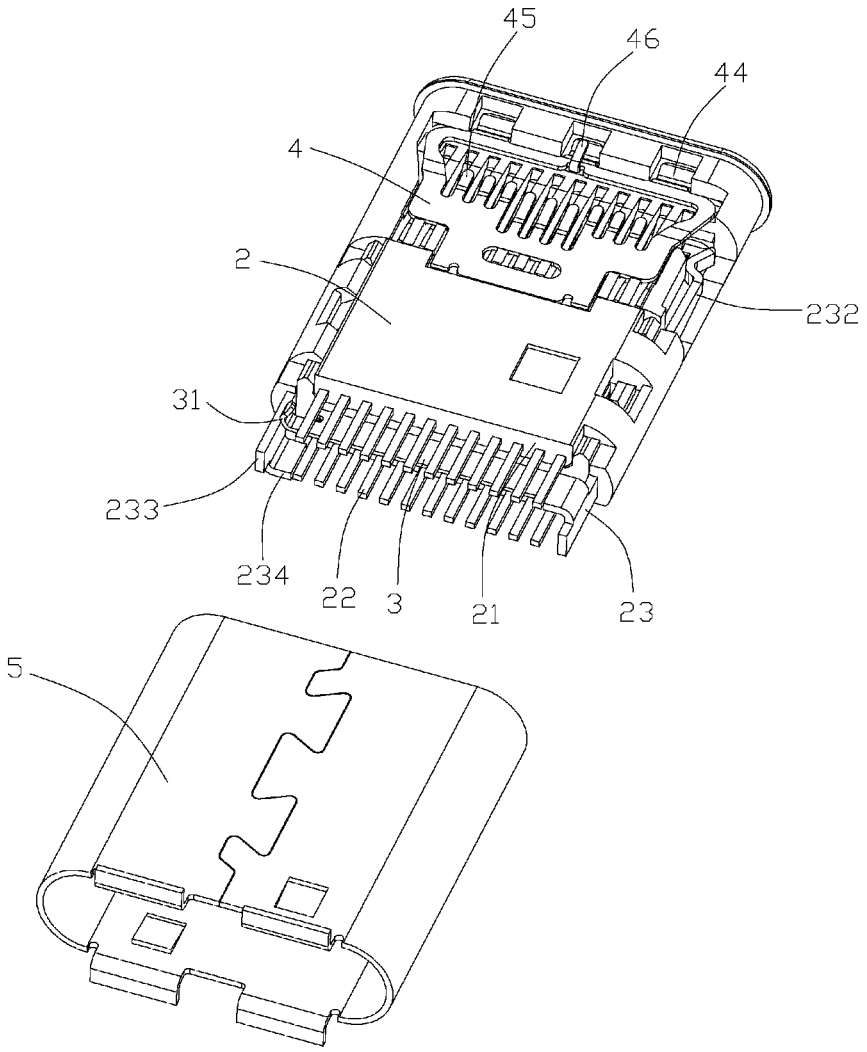
FIG. 4 is a view similar to FIG. 3, while viewed from another aspect.

Reference will now be made to the drawing figures to describe the embodiments of the present disclosure in detail. In the following description, the same drawing reference numerals are used for the same elements in different drawings.

Referring to FIGS. 1 to 8, a preferred illustrated embodiment of the present disclosure discloses an electrical connector 100. The electrical connector 100 comprises an insulative housing 1, a pair of contact modules 2 and a flake-shaped grounding member 3 retained in the insulative housing 1, a pair of shield blades 4 respectively located at upper and lower sides of the insulative housing 1, and an outer shield 5 surrounding the insulative housing 1.

Figure 5:
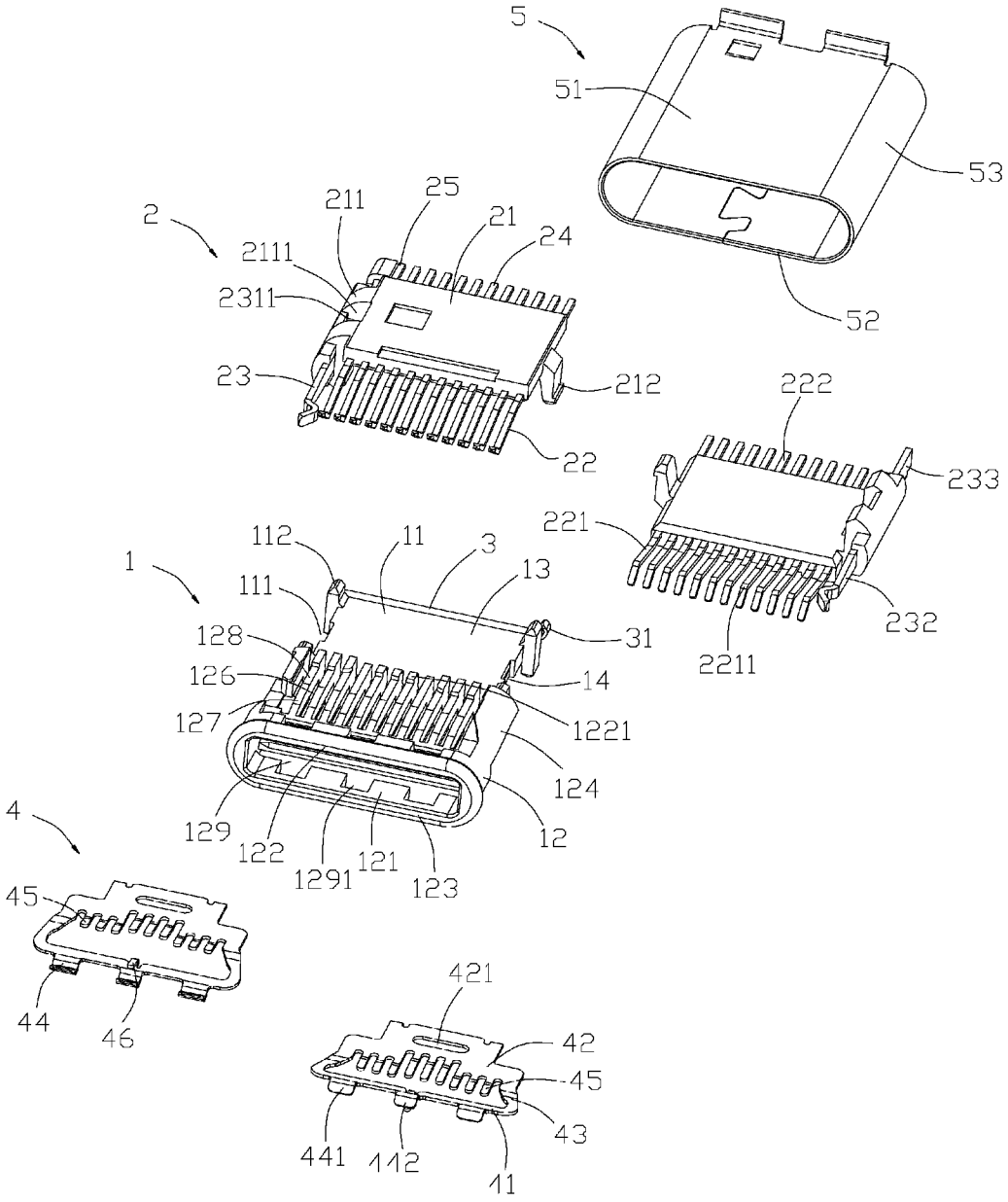
FIG. 5 is an exploded view of the electrical connector shown in FIG. 1.
Figure 6:
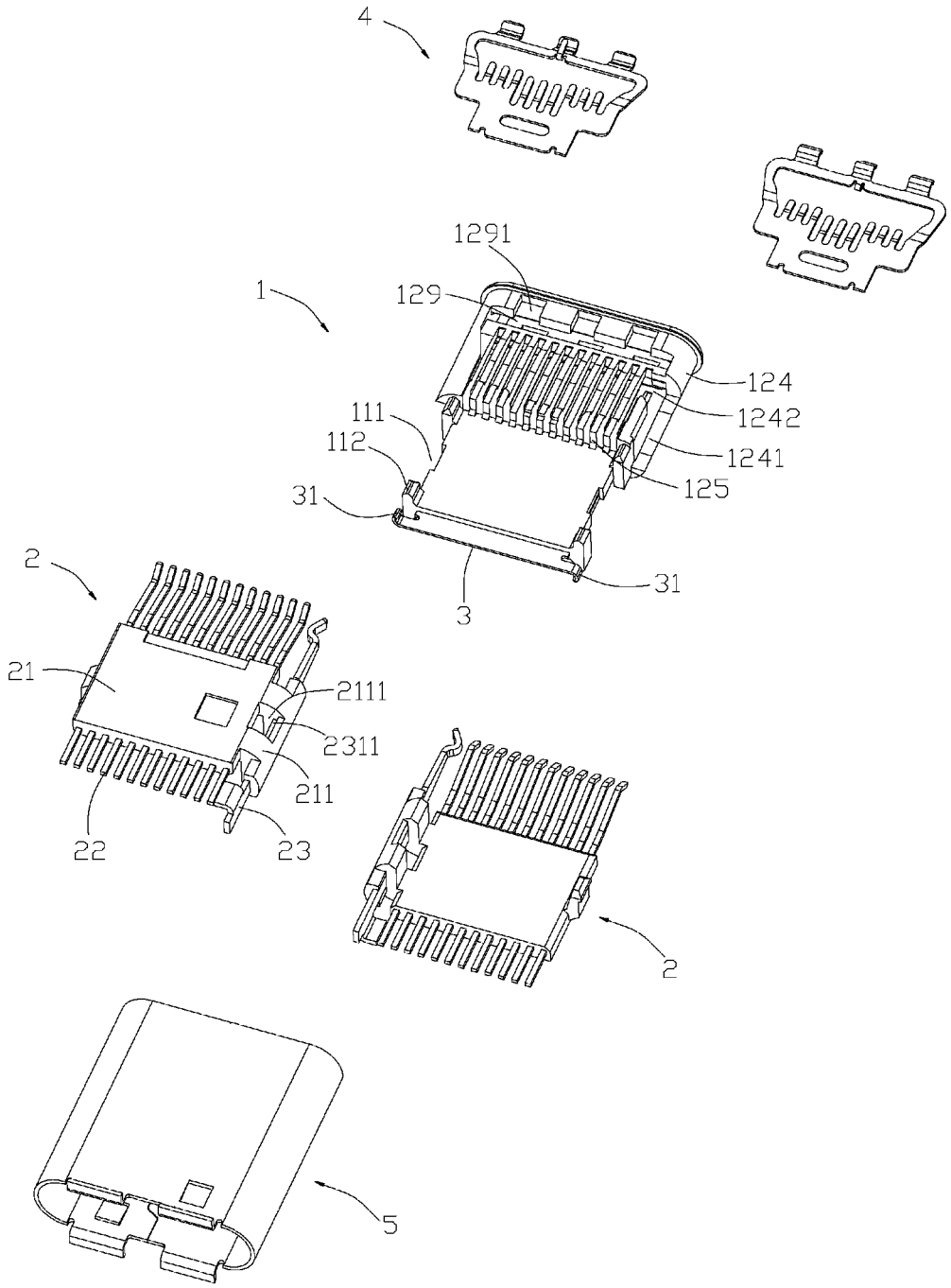
FIG. 6 is a view similar to FIG. 5, while viewed from another aspect.
Figure 7:
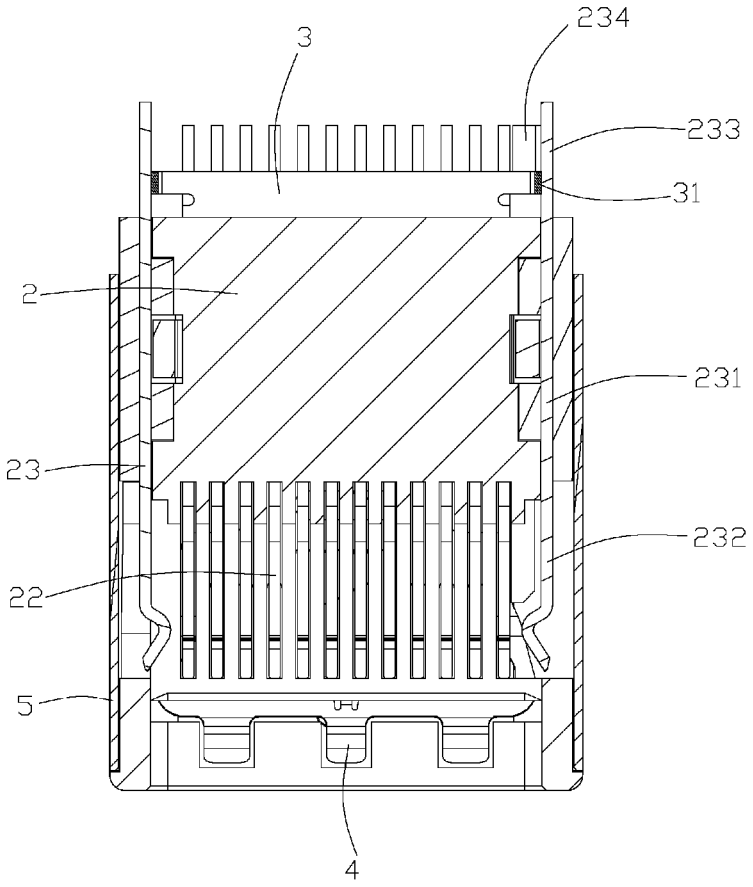
FIG. 7 is a cross-sectional view of the electrical connector shown in FIG. 1 along a transverse direction.
Figure 8:
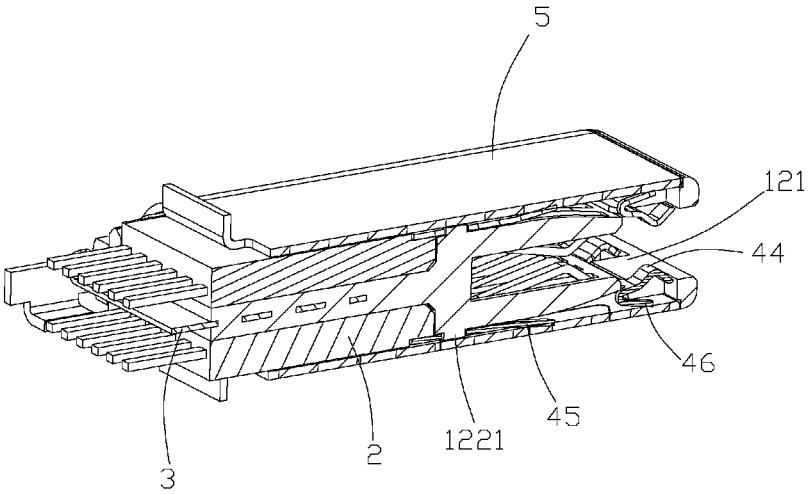
FIG. 8 is a cross-sectional view of the electrical connector shown in FIG. 1 along a longitudinal direction.

Referring to FIGS. 5 and 6, the insulative housing 1 has a body portion 11 and a mating portion 12 at a front side of the body portion 11. The body portion 11 is thinner than the mating portion 12, and the body portion 11 can be recognized as extending backwardly from a rear middle position of the mating portion 12. Therefore, there are an upper cavity 13 and a lower cavity 14 formed at upper and lower sides of the body portion 11 respectively. Besides, the insulative housing 1 further defines a pair of grooves 111 at two sides of the body portion 11 and two pairs of posts 112 located at front and rear sides of the grooves 111 respectively. The grooves 111 communicate with the upper and lower cavities 13, 14 along an up to down direction. The posts 112 extend upwardly or downwardly.

The mating portion 12 defines a receiving space 121 and has a top wall 122, a bottom wall 123, a pair of side walls 124 and a connection wall 125 around the receiving space 121. The connection wall 125 connects the body portion 11, the top wall 122, the bottom wall 123 and two side walls 124. The top wall 122, the bottom wall 123 and the connection wall 125 define a plurality of contact receiving slots 126 depressed from the outer surfaces thereof and a plurality of stalls 127 between adjacent contact receiving slots 126. The contact receiving slots 126 and the stalls 127 are arranged in a transverse direction. The contact receiving slots 126 communicate with the receiving space 121 along the up to down direction and communicate the receiving space 121 and the upper and lower cavities 13, 14 along a front to back direction.

Each of the top wall 122 and bottom wall 123 defines a recess 128 recessed from the outer surfaces thereof, and an indention 129 communicating the recess 128 and the receiving space 121. The recesses 128 are shallower than the contact receiving slots 126. The contact receiving slots 126 communicate with the recesses 128 and locate behind the indentions 129. The indention 129 extends through the top wall 122 or bottom wall 123 along the transverse direction. Besides, each of the top wall 122 and bottom wall 123 further defines a plurality of cutouts 127. The cutouts 127 are recessed forwardly from the front inner surfaces of the indentions 129. The side walls 124 and the connection wall 125 define a pair of notches 1241 upwardly or downwardly recessed from upper of lower side thereof. One of the notches 1241 is recessed upwardly from a lower side of one side wall 123, and another notch 1241 is recessed downwardly from an upper side of another side wall 123. The notches 1241 communicate with the grooves 111 along the front to back direction. Each notch 1241 is provided with an opening 1242 communicating with the receiving space 121.

Referring to FIGS. 1-4, 7 and 8, in the present embodiment, the middle grounding member 3 is insert-molded in the body portion 11, and has a flake-shaped base insert-molded in the body portion 11 and a pair of resilient strips 31 extending out of the body portion 11 from two sides thereof. One of the resilient strips 31 extends outwardly and bends upwardly, and another resilient strip 31 extends outwardly and bends downwardly.

Referring to FIGS. 1-8, the contact modules 2 are received in the upper and lower cavities 13, 14 respectively. Each contact module 2 is provided with an insulator 21, a plurality of contacts 22 and a locking spring 23 fixed in the insulator 21. In the present embodiment, the contacts 22 and the locking spring 23 are insert-molded in the insulator 21. Two contact modules 2 in the present invention are symmetrical in the transverse direction. Each insulator 21 has a locking portion 211 extending to one groove 111 from one side thereof and a hook 212 extending to another groove 111 from another side thereof. The posts 112 resist the locking portions 211 and limit the locking portion 211 from moving along the front to back direction. The contact modules 2 and the insulative housing 1 are fixed together by engagement of the locking portion 211 of one insulator 21 and the hook 212 of another insulator 21.

The contacts 22 in each contact module 2 are arranged in a row, and the contacts 22 of two contact modules 2 are arranged in two rows which face to face along the up to down direction. The contacts 2 of each contact module 2 comprise a plurality of signal contacts 24 and grounding contacts 25, and the grounding contacts 25 are located at two sides, and the signal contacts 24 are located between the grounding contacts 25. Besides, the signal contacts 24 in each row comprise three pairs of differential signal contacts and some other contacts between adjacent differential signal contacts. In the present invention, the contacts 22 in two rows are identical in signal transmission except that they are arranged reversely, therefore the mating connector can mate with the electrical connector 100 in the pros and cons.

Each contact 22 has a securing portion retained in the insulator 21, a contact arm 221 forwardly extending out of the insulator 21 and a connecting portion 222 backwardly extending out of the insulator 21. The contact arms 221 pass through the contact receiving slots 126 and extend into the receiving space 121 upwardly or downwardly. Each contact arm 221 possesses a V-shaped contact portion 2211 provided at a free end thereof. The contact portions 221 in two rows extend toward to each other, and are located at upper and lower sides of the receiving space 121 respectively, therefore a tongue of a mating connector (not shown) will be sandwiched between the contact portions 221.

The locking spring 23 in each contact module 2 is arranged in a lateral side of the contacts 22, and has a fixing portion 231 fixed in the insulator 21, a locking arm 232 forwardly extending into the receiving space 121, an extension tab 233 backwardly extending from a rear side of the fixing portion 231 and a grounding tab 234 extending from the extension tab 233. The fixing portion 231 is insert-molded in the locking portion 211. The locking portion 211 defines a locking hole 2111 extending therethrough along the up to down direction. The fixing portion 231 has a retaining tab 2311 exposed in the locking hole 2111 to lock with the hook 212. The locking springs 23 are made of metal material, therefore, the engagement between the hook 212 and the lock portion 211 can be strengthened by the retaining tab 2311.

The locking arm 232 are received in the notches 1241 and protrude into the receiving space 121 through the openings 1242 to lock with the mating connector. The extension tabs 233 abut against the resilient strips 31. The grounding tabs 234 connect with the grounding contacts 25 or a circuit board or a grounding cable (not shown), therefore, the locking springs 23 can not only be used to lock the mating connector, but also to prevent EMI in the receiving space 121. Besides, the middle grounding member 3 abuts against the extension tabs 233 that can prevent the securing portions of the contacts 22 in two contact modules 2 from interfering with each other and performance to prevent EMI between two contact modules 2.

Referring to FIGS. 1-6 and 8, The shield blades 4 are located at outside of the receiving space 121 and space apart from the contacts 22 along the up to down direction. In detail, the shield blades 4 are received in the recesses 128 of the upper and lower walls 122, 123, and locate at upper or lower side of the contact arms 221 to protect the contact arms 221 from being disturbed.

Each of the shield blades 4 is formed with a front bracket 41, a rear bracket 42, a pair of side brackets 43, a plurality of inner grounding arms 44 and a plurality of outer grounding arms 45 extending beyond the upper or lower walls 122, 123.

The front bracket 41 is received in the indentions 129. The inner grounding arms 44 extend forwardly and inwardly from the front bracket 41, and protrude into the receiving space 121 through the indentions 129. The rear brackets 42 are located at a rear side of the mating portion 12, and each of which defines a position hole 421. The mating portion 12 is formed with protrusions 1221 to engage with the position holes 421 of the rear brackets 42. The outer grounding arms 45 extend forwardly and outwardly from the rear bracket 42, and are arranged in the transverse direction. In the up to down direction, the outer grounding arms 45 correspond to the stalls 127; therefore, there is one outer grounding arm 45 between adjacent two contacts 22 that can prevent disturb or EMI between adjacent contacts 22.

The inner grounding arms 44 comprise a pair of external arms 441 at two sides and an internal arm 442 between the external arms 441. Besides, each shield blade 4 is further provided with a resisting arm 46 outwardly extending from the front bracket 41, and the resisting arm 46 corresponds to the internal arm 442 along the up to down direction.

The outer shield 5 has an upper wall 51, a lower wall 52 and a pair of connecting walls 53 connecting two sides of the upper wall 51 and the lower wall 52. The outer grounding arms 45 resist the upper wall 51 or the lower wall 52 outwardly.

Referring to FIGS. 1 to 8, in another aspect, the present invention further relates to a method of making the electrical connector 100 as described above, and the method comprises: firstly, providing a plurality of contacts 22 and locking springs 23, and fixing the contacts 22 and the locking springs 23 to a pair of insulators 21 in a preferred arrangement to form a pair of contact modules 2, the locking springs 23 being arranged at lateral sides of the contacts 22; secondly, providing a middle grounding member 3 and fixing the middle grounding member 3 to an insulative housing 1, the insulative housing 1 being provided with a mating portion 12, a body portion 11 behind the mating portion 12 and an upper cavity 13 and a lower cavity 14 located at upper and lower sides of the body portion 11 respectively, the mating portion 12 being provided with a top wall 122, a bottom wall 123, a pair of side walls 124 and a receiving space 121 formed therebetween, the middle grounding member 3 being fixed in the body portion 11; thirdly, assembling the pair of contact modules 2 to the upper and lower cavities 13, 14 respectively along an up to down direction, wherein each locking spring 23 having a fixing portion 231 fixed in the insulator 21, a locking arm 232 forwardly extending to the receiving space 121 and an extension tab 233 backwardly extending from a rear side of the fixing portion 231, each of the contacts 22 having a contact arm 221 extending to the receiving space 121.

In the embodiment of the present invention, the contacts 22 and the locking springs 23 are insert-molded in the insulators 21 in the preferred arrangement, and the middle grounding member 3 is insert-molded in the body portion 11 and is provided with a pair of resilient strips 31 extending out of the body portion 11 from two sides thereof. The extension tabs 233 of the locking springs 23 abut against the resilient strip 31.

Besides, the method further comprises: providing a pair of shield blades 4 and assembling the shield blades 4 to outside of the receiving space 121, each shield blade 4 being provided with a plurality of inner grounding arms 44 and outer grounding arms 45, the inner grounding arms 44 protruding into the receiving space 121, and the outer grounding arms 45 protruding beyond the top wall 122 or bottom wall 123; and providing an outer shield 5 and ringing the outer shield 5 to the insulative housing 1, the outer shield 5 being provided with an upper wall 51, a lower wall 52 and a pair of connecting walls 53 connecting two sides of the upper wall 51 and the lower wall 52; wherein the outer grounding arms 45 resist the upper wall 51 or the lower wall 52 of the outer shield 5 outwardly.

As described above, the contacts 22, the locking springs 23 and the insulators 21 are fixed together to form the contact modules 2, then assemble the contact modules 2 to the insulative housing 1, that can make the assembly of the electrical connector 100 easier, and the insulative housing 1 will have a stable structure via avoiding more retaining slots formed thereon to engage with the contacts 22 or locking springs 23 etc. Besides, the structure of the electrical connector 100 can avoid the members of the electrical connector 100 from interfering with each other in the assembling process.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector, comprising:

an insulative housing having a mating portion, a body portion behind the mating portion and an upper cavity and a lower cavity located at upper and lower sides of the body portion respectively, the mating portion being provided with a top wall, a bottom wall, a pair of side walls and a receiving space formed therebetween;

a middle grounding member being retained in the body portion; and a pair of contact modules, each of the contact modules having an insulator received in the upper or lower cavity, a plurality of contacts and a locking spring fixed in the insulator, the locking spring being arranged at a lateral side of the contacts and having a fixing portion fixed in the insulator, a locking arm forwardly extending to the receiving space and an extension tab backwardly extending from a rear side of the fixing portion, each of the contacts having a contact arm extending to the receiving space.

2. The electrical connector as claimed in claim 1, wherein the middle grounding member has a pair of resilient strips extending out of the body portion from two sides thereof, and the extension tab abuts against the resilient strip, the locking spring further having a grounding tab extending from the extension tab.

3. The electrical connector as claimed in claim 1, wherein the contacts and the locking spring are insert-molded in the insulator, and the middle grounding member is insert-molded in the body portion.

4. The electrical connector as claimed in claim 1, wherein the insulative housing further defines a pair of grooves at two sides of the body portion, and the grooves communicate with the upper and lower cavities along an up to down direction; the contact modules being symmetrical in a transverse direction, and each insulator having a locking portion extending to one groove from one side thereof and a hook extending to another groove from another side thereof; the contact modules and the insulative housing being fixed together by engagement of the locking portion of one insulator and the hook of another insulator.

5. The electrical connector as claimed in claim 4, wherein the locking portion defines a locking hole extending therethrough along the up to down direction, the locking spring being insert-molded in the locking portion and having a retaining tab exposed in the locking hole to lock with the hook.

6. The electrical connector as claimed in claim 4, wherein the body portion is thinner than the mating portion, and the mating portion is further provided with a connection wall connecting the body portion and the top wall, bottom wall and two side walls; the top wall, the bottom wall and the connection wall defining a plurality of contact receiving slots depressed from the outer surfaces thereof and a plurality of stalls between adjacent contact receiving slots, the contact receiving slots communicating with the receiving space along the up to down direction and communicating the receiving space and the upper and lower cavities along a front to back direction; the contact arms protruding into the receiving space through the receiving slots and being located at upper and lower sides of the receiving space.

7. The electrical connector as claimed in claim 6, wherein the side walls and the connection wall define a pair of notches upwardly or downwardly recessed from upper of lower side thereof, and the notches communicate with the grooves along the front to back direction, each notch being provided with an opening communicating with the receiving space, and the locking arm having a locking barb protruding into the receiving space through the opening.

8. The electrical connector as claimed in claim 6, further comprising a pair of shield blades locating at outside of the receiving space, each shield blade having a plurality of inner grounding arms and outer grounding arms, the inner grounding arms protruding into the receiving space, and the outer grounding arms protruding beyond the top wall or bottom wall; and an outer shield surrounding the insulative housing, the outer shield having an upper wall, a lower wall and a pair of connecting walls connecting two sides of the upper wall and the lower wall;

wherein the outer grounding arms resist the upper wall or the lower wall of the outer shield outwardly.

9. The electrical connector as claimed in claim 8, wherein the outer grounding arms are located at outside of the stalls and corresponds to the stalls; each shield blade having a rear bracket, a front bracket and a pair of side brackets, the outer grounding arms extending forwardly and outwardly from the rear bracket, the inner grounding arms extending forwardly and inwardly from the front bracket.

10. The electrical connector as claimed in claim 9, wherein each of the top wall and bottom wall defines a recess recessed from the outer surfaces thereof and an indention communicating the recess and the receiving space, the recesses being shallower than the contact receiving slots, the shield blade being received in the recess, and the inner grounding arms passing through the indention.

11. The electrical connector as claimed in claim 10, wherein the indentions extend through the top wall of bottom wall along a transverse direction, the front brackets being received in the indentions.

12. The electrical connector as claimed in claim 10, wherein the inner grounding arms comprise a pair of external arms at two sides and an internal arm between the external arms, the shield blade being further provided with a resisting arm outwardly extending from the front bracket, and the resisting arm corresponding to the internal arm along the up to down direction.

13. A method of making an electrical connector comprising:

providing a plurality of contacts and locking springs and fixing the contacts and the locking springs to a pair of insulators in a preferred arrangement to form a pair of contact modules, the locking springs being arranged at lateral sides of the contacts;

providing a middle grounding member and fixing the middle grounding member to an insulative housing, the insulative housing being provided with a mating portion, a body portion behind the mating portion and an upper cavity and a lower cavity located at upper and lower sides of the body portion respectively, the mating portion being provided with a top wall, a bottom wall, a pair of side walls and a receiving space formed therebetween, the middle grounding member being fixed in the body portion; and assembling the pair of contact modules to the upper and lower cavities respectively along an up to down direction, wherein each locking spring having a fixing portion fixed in the insulator, a locking arm forwardly extending to the receiving space and an extension tab backwardly extending from a rear side of the fixing portion, each of the contacts having a contact arm extending to the receiving space.

14. The method of making an electrical connector as claimed in claim 13, wherein the contacts and the locking springs are insert-molded in the insulators in the preferred arrangement.

15. The method of making an electrical connector as claimed in claim 13, wherein the middle grounding member is insert-molded in the body portion, and is provided with a pair of resilient strips extending out of the body portion from two sides thereof, the extension tab abutting against the resilient strip.

16. The method of making an electrical connector as claimed in claim 13, wherein the insulative housing is further provided with a pair of grooves at two sides of the body portion, and the grooves communicate with the upper and lower cavities along an up to down direction; the contact modules being symmetrical in a transverse direction, and each insulator being provided with a locking portion extending to one groove from one side thereof and a hook extending to another groove from another side thereof; the contact modules and the insulative housing being fixed together by engagement of the locking portion of one insulator and the hook of another insulator.

17. The method of making an electrical connector as claimed in claim 16, wherein the locking portion is provided with a locking hole extending therethrough along the up to down direction, the locking spring being insert-molded in the locking portion and having a retaining tab exposed in the locking hole to lock with the hook.

18. The method of making an electrical connector as claimed in claim 16, wherein the body portion is thinner than the mating portion, and the mating portion is further provided with a connection wall connecting the body portion and the top wall, bottom wall and two side walls; the top wall, the bottom wall and the connection wall defining a plurality of contact receiving slots depressed from the outer surfaces thereof and a plurality of stalls between adjacent contact receiving slots, the contact receiving slots communicating with the receiving space along the up to down direction and communicating the receiving space and the upper and lower cavities along a front to back direction; the contact arms protruding into the receiving space through the receiving slots and being located at upper and lower sides of the receiving space.

19. The method of making an electrical connector as claimed in claim 18, wherein the side walls and the connection wall are provided with a pair of notches upwardly or downwardly recessed from upper of lower side thereof, and the notches communicate with the grooves along the front to back direction, each notch being provided with an opening communicating with the receiving space, and the locking arm having a locking barb protruding into the receiving space through the opening.

20. The method of making an electrical connector as claimed in claim 13, further comprising:

providing a pair of shield blades and assembling the shield blades to outside of the receiving space, each shield blade being provided with a plurality of inner grounding arms and outer grounding arms, the inner grounding arms protruding into the receiving space, and the outer grounding arms protruding beyond the top wall or bottom wall; and providing an outer shield and ringing the outer shield to the insulative housing, the outer shield being provided with an upper wall, a lower wall and a pair of connecting walls connecting two sides of the upper wall and the lower wall;

wherein the outer grounding arms resist the upper wall or the lower wall of the outer shield outwardly.

* * * * *